United States Patent [19]

Raiski

[11] Patent Number: 4,677,746

[45] Date of Patent: Jul. 7, 1987

[54] ASSEMBLY FOR ATTACHING A CUTTER BLADE INTO A CHAIN SAW

[76] Inventor: Juhani Raiski, P.O. Box 26 SipiläSF-34801 Virrat, Finland

[21] Appl. No.: 810,005

[22] Filed: Dec. 17, 1985

[30] Foreign Application Priority Data

Dec. 21, 1984 [FI] Finland ..... 845087

[51] Int. Cl.[4] ..... B27B 17/00

[52] U.S. Cl. ..... 30/122; 30/381

[58] Field of Search ..... 29/434; 30/381–387, 30/122

[56] References Cited

U.S. PATENT DOCUMENTS

| | | | |
|---|---|---|---|
| 2,774,395 | 12/1956 | Tweedie | 30/387 |
| 3,157,211 | 11/1964 | Wiig | 30/386 |
| 4,033,035 | 7/1977 | Trimmer | 30/122 |
| 4,270,270 | 6/1981 | Loyd | 30/386 X |
| 4,272,889 | 6/1981 | Scott | 30/371 |
| 4,316,327 | 2/1982 | Scott | 30/386 |
| 4,382,334 | 5/1983 | Reynolds | 30/386 |

FOREIGN PATENT DOCUMENTS

| | | |
|---|---|---|
| 2004657 | 8/1971 | Fed. Rep. of Germany . |
| 155165 | 7/1956 | Sweden . |
| 1567557 | 5/1890 | United Kingdom . |
| 914377 | 1/1963 | United Kingdom . |
| 2042974 | 10/1980 | United Kingdom . |

*Primary Examiner*—Timothy V. Eley

*Attorney, Agent, or Firm*—Andrus, Sceales, Starke & Sawall

[57] ABSTRACT

An assembly for the attachment of a cutter blade into a chain saw. The saw consists of a frame including controls and drive mechanism as well as a protruding cutter blade (2) encircled by an endless toothed chain that receives its motive power from the shaft of a motor mounted to the frame. The cutter blade (2) and the power transmission unit (16) to be connected to the saw shaft are mounted to an auxiliary frame (18). The auxiliary frame (18) has fasteners (17) and the saw frame is fitted with counterparts (10, 11) for attaching the auxiliary frame (18) into the saw frame (1) using the fastener (17) so that the transmission unit (16) is in power transmitting connection with the saw shaft (4).

13 Claims, 6 Drawing Figures

ASSEMBLY FOR ATTACHING A CUTTER BLADE INTO A CHAIN SAW

The subject of the invention is an assembly for attaching a cutter blade into a chain saw. The saw consists of a frame including controls and drive mechanism as well as a protruding blade encircled by an endless tooth chain receiving its motive power from a motor attached to the frame.

BACKGROUND OF THE INVENTION

Most of the chain saws in use, when properly maintained and prepared, do perform the job they have been fitted for in a satisfactory way. Yet they have a shortcoming that cuts the actual working hours. In the dark time of the year, in particular, the effective working hours of a forest worker are limited into the lightest hours of the day, that is six hours a day more or less. The chain saw is used in cutting and delimbing a tree, and the effective working hours consumed in these operations are a decisive factor in the whole process. If the chain or the cutter blade as a whole has to be replaced in the forest, as is frequently the case, work efficiency is crucially affected. The chain may be damaged or broken or the chain has to be tightened at times. Besides, it would often be of advantage to use different chain and different blade length in cutting and delimbing. The chain saws presently used fail to allow for such considerations to a sufficient extent. They are composed of a number of separate parts that must be used and handled whenever the cutter blade is changed or adjusted. Such parts include all the following: chain, blade, side cover, bolts and chain tensioner. The saw has to be disassembled far enough to call it a time-consuming and inconvenient process in field conditions.

SUMMARY OF THE INVENTION

The purpose of the invention is to remove the above failures and to produce means of attaching a cutter blade into a chain saw in a way that enables easy and quick change of the cutter blade in field conditions. The operator can quickly replace the cutter blade if it is damaged or whenever an operation calls for another type of cutter blade. Service can always be carried out in the best possible conditions and only the above-mentioned changes take place in the forest. Service or repair in field conditions are not necessary only the operator has an adequate number of cutter blades at his disposal in the forest. For instance, if the chain is damaged, the work is only interrupted for the short time that is needed for a change.

To produce the above-mentioned advantages, the invented assembly for attaching a cutter blade into a chain saw is essentially characterized by the facts that the cutter blade as well as the power transmission unit to be connnected to the saw axle are mounted to an auxiliary frame, that the auxiliary frame is fitted with means of attachment and that the saw frame is fitted with counterparts for the attachment of the auxiliary frame to the saw frame so that the transmission unit is in a a power transmitting contact with the saw axle.

Other characteristics of the invention are explained in the following subclaims including a few embodiments of advantage.

DESCRIPTION OF THE DRAWINGS

The following is an illustration of one embodiment of the invented assembly with references to the enclosed drawings.

DESCRIPTION OF THE ILLUSTRATED EMBODIMENT

Figure 1:
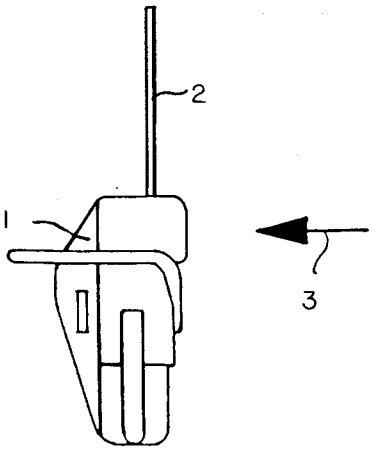
FIG. 1 is an overall view of the chain saw from above, where the arrow shows the direction of mounting the auxiliary frame of the assembly.

In the overall view in FIG. 1, number 1 refers to the saw frame. Number 2 refers to the cutter blade including toothed chain. Arrow 3 shows the direction of mounting the auxiliary frame of the assembly.

Figure 3:
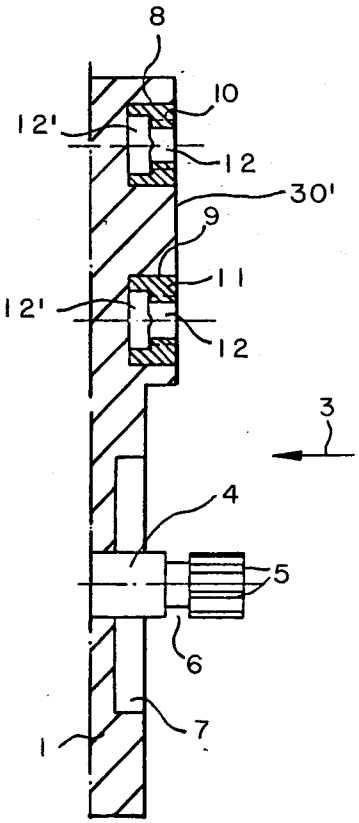
FIG. 3 is section A—A of FIG. 2
Figure 2:
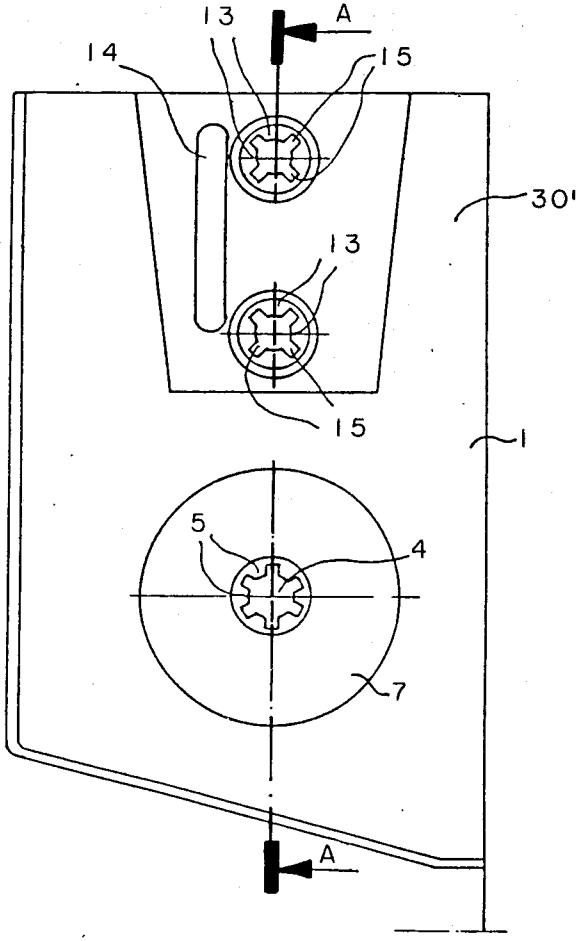
FIG. 2 shows the saw frame as seen from the direction of mounting the auxiliary frame.

FIG. 2 shows the saw frame 1 as seen from the mounting direction particularly at the auxiliary frame. FIG. 3 is section A—A of FIG. 2 at the crankshaft 4. For the use of the invented assembly the end of the crankshaft 4 of the saw motor is formed into a cylinder with grooving 5 lengthwise. Behind the cylinder in the mounting direction there is a radial groove 6. Further, the frame 1 has a recess 7 around the crankshaft 4.

FIGS. 2 and 3 also show the construction of the counterparts of the assembly. Holes 8 and 9 are drilled into the frame 1 preferably so that the centres of the holes lie in the centre line of the cutter blade. The holes 8 and 9 are internally threaded and their counterpieces 10 and 11 are externally threaded. Both have a central axial hole 12, which is a 4-grooved (grooves 15) key hole. The bottom 12' of each hole 12 is cylindrical, the diameter corresponding to the distance between the bottoms of the opposite grooves 15. Four axial locking necks 13 are thus formed between the grooves 15.

Further, the frame 1 has a groove 14 parallel to the length of the cutter blade.

Figure 4:
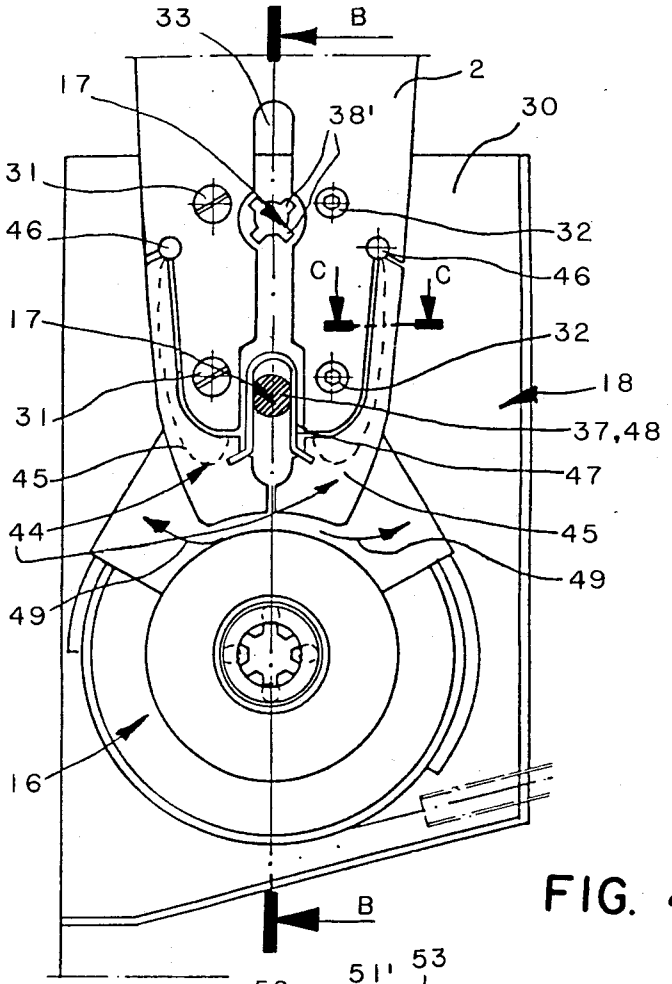
FIG. 4 shows the auxiliary frame as seen perpendicular to the mounting direction.
Figure 5:
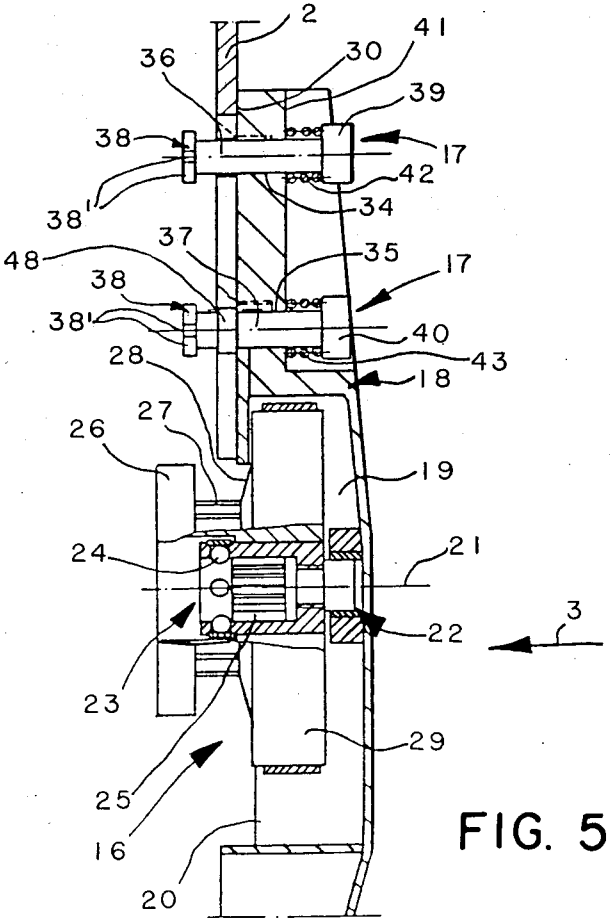
FIG. 5 is section B—B of FIG. 4

FIG. 4 shows the auxiliary frame including transmission unit and cutter blades (without chain) as seen from the opposite direction of mounting and FIG. 5 section B—B at the transmission unit 16 and the middle axis of the quick fasteners 17. The auxiliary frame 18 includes a casing 19, whose opening 20 opens to the mounting direction while the auxiliary frame 18 surrounds the other sides of the casing 19. The transmission unit 16 is mounted in bearings to the bottom of the casing 19 so as to revolve around an axle 21 which runs parallel to the mounting direction. The mounting in bearings and the axles are generally referred to by number 22. The transmission unit 16 has a hole 23 parallel with the middle axis 21. The hole 23 is fitted with, first in the mounting direction, a radially flexible axial locking unit, circle balls 24 in particular, (in attachment acting together with groove 6 of shaft 4, FIG. 3). The latter part of the hole 23 has a longitudinal grooving or spline 25 (acting together with the grooving or spline 5 of the shaft, FIG. 3). Through these parts 24, 25 of the transmission unit the auxiliary frame 18 is brought into power transmitting connection with the shaft 4 of the saw motor. Further, the transmission unit 16 contains as external parts, first in the mounting direction, a protective flange 26 (fits into recess 7, FIG. 3), next a drive gear 27 acting together with the chain in order to pass on the rotation movement of the transmission unit 16 to the chain in longitudinal direction of the cutter blade 2. Next in the mounting direction comes a dowel pin 28 and a centrifugal coupling 29, then the above mentioned mounting in bearings 22 through which the transmission unit 16 is fastened to the auxiliary frame 18.

The cutter blade 2 has been attached to face 30 of the auxiliary frame 18. The face 30 is essentially parallel to the counter face (30', FIG. 3) of the frame when the auxiliary frame 18 is attached and essentially perpendicular to the middle axis 21. The cutter blade is fixed with four screws 31, 32, the former with countersunk and the latter with raised head (setting into the groove 14 of the frame 1 for additional support, FIG. 2).

Further, the auxiliary frame 18 is fitted with quick fasteners 17 at the face 30. For them the cutter blade 2 is equipped with a groove 33, at which the quick fasteners protrude from the side surface of the cutter blade to the mounting direction. Through the auxiliary frame 18 there are holes 34, 35 in the mounting direction, into which the axles 36, 37 of the quick fasteners 17 are fitted. The quick fasteners 17 are able to revolve around their longitudinal axis and their ends are equipped with a four-arm locking shoulder 38 (acting together with the holes 12, 12' of the frame 1, FIGS. 2 and 3). In the first stage of attachment the arms go through the holes 12, whereby the arms 38' lie in the grooves 15, after which the quick fasteners 17 are turned around their longitudinal axis, whereby the arms 38 move to the necks 13 in axial direction. The thickness of the necks and/or the arms may vary in the mounting direction to produce a wedge-like tension, which prevents the quick fasteners from turning loose unnecessarily. In the mounting direction the necks prevent the quick fasteners from moving in axial direction and thus lock the auxiliary frame 18 into the frame 1. Further, the axles 36, 37 of the quick fasteners are equipped with external threads at the opposite end of the arms 38', and sleeve-like extension parts 39, 40 equipped with internal threads are fittted into these. Between the extension parts 39, 40 and the outer surface 41 of the auxiliary frame 18 there are pressure springs 42, 43, whose spring power affects in a direction perpendicular to the mounting direction. This increases the tension effect of the quick fasteners and enables tension adjustment by turning the extension parts 39, 40.

FIG. 4 also shows an invented method of tightening the chain, generally referred to by number 44. Tension plates 45 affect at the head level of the cutter blade 2 (level in FIG. 4). They are pivoted around axles 46 perpendicular to the head level of the cutter blade 2 through a spring 47 affecting in the direction parallel to the head level. The spring 47 is a U- or V-shaped plate spring placed in the groove 33 of the cutter blade 2 so that the axle 37 of one quick fastener is between the U- or V-shape. The arm ends of the U- or V-shape are fastened to the tension plates 45. At the tensioner of the axle 37 there is a shoulder 48, whose radial extension varies in the direction of the circle of the axle 37 so that when the corresponding quick fastener is turned into closing position, the larger diameter of the shoulder affects the arms of the U- or V-shaped spring 47 spreading it so that it turns the tension plates 45 towards the chain (arrows 49, FIG. 4) around the axles 46. This lengthens the circle along which the chain runs around the cutter blade 2 and drive gear 27, and the chain tightens.

Figure 6:
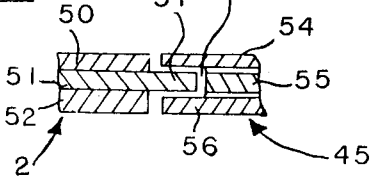
FIG. 6 is section C—C of FIG. 4.

FIG. 6 shows the support between the tension plates 45 and the cutter blade. The cutter blade 2 is made of three plates 50, 51, 52 joined together, the middle plate 51 (part 51') extending past the edges of the outer plates 50, 52 to a groove 53 in the tension plate, the groove 53 being at the middle plate 55 of the tension plates also made by joining three plates 54, 55, 56 together.

It is obvious to an expert that the above embodiment is one usable application of the basic idea of the invention, and it is clear to him that it can be varied in a number of ways within the framework of the basic idea.

The point of the invention is that the auxiliary frame which the cutter blade and the power transmission unit are mounted to, can be replaced quickly in field conditions. The change normally takes less than a minute. By equipping an auxiliary frame, easily removed and easily attached, with all the parts that in previous designs are detachable to allow replacement, the major advantage can be achieved that various chains, cutter blades of different lengths, etc. can be used in the forest without affecting work efficiency. The service of the chains, such as grinding, filing and setting as well as their change can always be carried out in optimum circumstances providing that the operator has a necessary number of the required auxiliary frames including cutter blades, transmission devices and fasteners at his disposal.

I claim:

1. A chain saw assembly, comprising a main frame having a power unit and a drive member, an auxiliary frame removably connected to the main frame and having a cutter blade to carry an endless cutter chain and a power transmission unit, said power transmission unit including a driven member, connecting means for operably connecting said drive member to said driven member, said connecting means arranged to transmit rotation from said drive member to said driven member and permit relative axial movement between said members, fastening means separate from said members for releasably connecting said auxiliary frame to said main frame, and a driving element disposed on said auxiliary frame coaxially of said driven member, said driving element being operably connected to said driven member and engaged with said chain to drive said chain, release of said fastening means enabling said auxiliary frame to be removed from said main frame without disengagement of said drive element from said chain.

2. The assembly of claim 1, and including chain tensioning means carried solely by said auxiliary frame for adjusting the tension on said chain.

3. The assembly of claim 2, wherein said chain tensioning means comprises a tensioning member pivotably connected to said auxiliary frame, and biasing means for urging said tensioning member in a direction to apply tension to said chain.

4. The assembly of claim 2, wherein said chain tensioning means comprises a pair of tensioning members, each tensioning member being pivotably connected to said auxiliary frame and operably connected to said chain, and a resilient member disposed between said tensioning members for urging each tensioning member in a direction to apply tension to said chain.

5. The assembly of claim 4, wherein said resilient member comprises a generally U-shaped spring having a pair of legs with each leg being disposed in engagement with one of said tensioning members.

6. The assembly of claim 5, and including rotatable cam means disposed between said legs, rotation of said cam means acting to move said legs in a direction away from each other to apply tension to said chain.

7. The assembly of claim 6, wherein said cam means is operably connected to said fastening means.

8. The assembly of claim 1, wherein said drive member comprises a drive shaft and a gear mounted on said drive shaft, said drive member comprising an internally splined sleeve connected to said gear.

9. The assembly of claim 8, and including bearing means disposed on said auxiliary frame for journalling said shaft.

10. The assembly of claim 9, wherein said drive element comprises a gear disposed radially outward of said bearing means.

11. The assembly of claim 1, wherein said fastening means comprises a shaft connected to said auxiliary frame and having a first locking element, said main frame being formed with an opening, a second locking element disposed within said opening, said first locking element being engagable with said second locking element to connect said auxiliary frame to said main frame.

12. The assembly of claim 11, wherein said locking elements are constructed and arranged so that rotation of said first locking element will move said locking elements between a locking and a release position.

13. The assembly of claim 12, and including biasing means for urging said shaft and said first locking element in a direction away from said main frame.

* * * * *